United States Patent [19]

Kondo et al.

[11] Patent Number: 4,480,020

[45] Date of Patent: Oct. 30, 1984

[54] POLYMERIC PHOTOCONDUCTIVE SENSITIZED BY BIS(β-CYANO-β-ALKOXYCARBONYL-VINYL)BENZENE

[75] Inventors: Syunichi Kondo; Hideo Sato; Satoru Honjo, all of Saitama; Akira Umehara, Kanagawa, all of Japan

[73] Assignee: Fuji Photo Film Co., Ltd., Kanagawa, Japan

[21] Appl. No.: 486,272

[22] Filed: Apr. 18, 1983

Related U.S. Application Data

[63] Continuation of Ser. No. 339,794, Jan. 15, 1982, abandoned, which is a continuation of Ser. No. 160,895, Jun. 19, 1980, abandoned.

[30] Foreign Application Priority Data

Jun. 19, 1979 [JP] Japan ..... 54-77153

[51] Int. Cl.[3] ..... G03G 5/07; G03G 5/09

[52] U.S. Cl. ..... 430/81; 430/83; 430/900

[58] Field of Search ..... 430/81, 83, 900

[56] References Cited

U.S. PATENT DOCUMENTS 3,421,891 1/1969 Inami et al. ..... 430/81 X
3,721,552 3/1973 Tellier et al. ..... 430/83
4,069,046 1/1978 Hoegl et al. ..... 430/81
4,184,871 1/1980 Oba ..... 430/81 X

*Primary Examiner*—Roland E. Martin
*Attorney, Agent, or Firm*—Sughrue, Mion, Zinn, Macpeak & Seas

[57] ABSTRACT

A photoconductive composition containing as essential components a photoconductive polymer and 1,4-bis(β-cyano-β-alkoxycarbonylvinyl)benzene represented by the following formula (I)

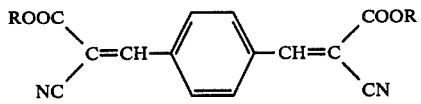

(I)

wherein R represents a methyl group, an ethyl group, a propyl group or an isopropyl group, present in an amount of about 0.02 mol to 0.5 mol per mol of a π-electron system-containing constitutional repeating unit present in the photoconductive polymer, and which forms a charge transfer complex with the photoconductive polymer through the π-electron system having optical sensitivities in the ultraviolet to visible regions; and an electrophotographic light-sensitive material incorporating the aforesaid photoconductive composition in a layer on a support having a conductive surface.

12 Claims, No Drawings

POLYMERIC PHOTOCONDUCTIVE SENSITIZED BY BIS(β-CYANO-β-ALKOXYCARBONYLVINYL)-BENZENE

This is a continuation of application Ser. No. 339,794, filed Jan. 15, 1982, now abandoned, which is a continuation of application Ser. No. 160,895 filed June 19, 1980, now abandoned.

BACKGROUND OF THE INVENTION

1. Field of the Invention

The present invention relates to a photoconductive composition and to a highly sensitive electrophotographic light-sensitive material incorporating such a photoconductive composition, more particularly, it is concerned with a colorless or lightly colored photoconductive composition and a colorless or lightly colored electrophotographic light-sensitive material which has high sensitivity and low residual potential.

2. Description of the Prior Art

Organic photosemiconductors have been studied for a long time for their application in the field of electrophotography. In particulars polyvinyl carbazole is described as being photoconductive and used in an electrophotographic material in German Patent Publication No. 106,811 and U.S. Pat. No. 3,037,861. In addition, the aforementioned German Patent Publication discloses that the optical sensitivity of polyvinyl carbazole can be particularly enhanced by the addition of dyes thereof in small amounts. Electrophotographic recording materials having photoconductive coatings of polymerized heterocyclic vinyl compounds such as polyvinyl carbazole and 2,3,7-trinitro-9-fluoroenone in an amount of about 0.49 to 1.23 mol per mol of the π-electron system containing constitutional repeating unit of the photoconductive polymer are described in German Patent Publication No. 1,572,347 and U.S. Pat. No. 3,484,237. In another electrophotographic recording material, which is described in German Patent Application (OLS) No. 1,797,561, the photoconductive layer is formed from a photoconductive composition containing 2,4,7-trinitro-9-fluorenone and polyvinyl carbazole in the equal amount (by weight). The report published by R. M. Scheffelt in *IBM Journal of Research and Development*, Vol. 15, No. 1, pp. 75–89 (1971) teaches that each of the above recording materials has excellent properties. On the other hand, the report states on page 76 that a large number of substances described as being a sensitizer for polyvinyl carbazole exert a bad influence on optical sensitivity when used in high concentrations. Further, the same report states on page 77 that 2,4,7-trinitro-9-fluorenone is the most useful of substances which have so far been found useful as a sensitizer for polyvinyl carbazole. However, trinitrofluorenone is relatively expensive and is very toxic, i.e., it has a strong carcinogenicity.

SUMMARY OF THE INVENTION

Therefore, one object of the present invention is to provide a photoconductive system that exhibits an optical sensitivity equal to that of a polyvinyl carbazole-trinitrofluorenone system and that can be manufactured at a low price.

Another object of the present invention is to provide an electrophotographic light-sensitive material incorporating such a photoconductive composition.

The above-described objects of the present invention are attained with a photoconductive composition comprising a photoconducitive polymer and a 1,4-bis(β-cyano-β-alkoxycarbonylvinyl)benzene represented by the following formula (I)

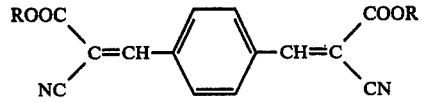

(I)

wherein R represents a methyl group, an ethyl group, a propyl group or an isopropyl group, in which the amount of 1,4-bis(β-cyano-β-alkoxycarbonylvinyl)benzene is about 0.02 to 0.5 mol per mol of π-electron system-containing constitutional repeating unit present in the photoconductive polymer, and with an electrophotographic light-sensitive material comprising a support having a conductive surface further having thereon a layer of the aforesaid photoconductive composition.

DETAILED DESCRIPTION OF THE INVENTION

Specific examples of 1,4-bis(β-cyano-β-alkoxycarbonylvinyl)benzenes represented by the general formula (I) include 1,4-bis(β-cyano-β-methoxycarbonylvinyl)benzene, 1,4-bis(β-cyano-β-ethoxycarbonylvinyl)benzene, 1,4-bis(β-cyano-β-propoxycarbonylvinyl)benzene and 1,4-bis(β-cyano-isopropoxycarbonylvinyl)benzene. Each of these compounds can be manufactured by dehydrocondensation of terephthalaldehyde and alkylcyanoacetate (the alkyl moiety of which corresponds to the methyl, ethyl, propyl, or isopropyl group defined for R) in the presence of an alkali as a catalyst according to the Knoevenagel method. Suitable alkali are amines such as dimethylamine, diethylamine, triethylamine, piperidine, etc., ammonia and the like.

Polymers containing π-electron systems in the main chain or the side chains can be employed as the photoconductive polymer in the present invention. 1,4-Bis(β-cyano-β-alkoxycarbonylvinyl)benzene represented by the general formula (I) (abbreviated as biscyanovinylbenzene) forms a charge transfer complex together with the π-electron system in the photoconductive polymer. Typical examples of π-electron systems include aromatic hydrocarbons such as naphthalene, anthracene, pyrene, perillene, acenaphthylene, phenylanthracene, diphenylanthracene, etc.; heterocyclic compounds such as carbazole, indole, acridine, 2-phenylindole, N-phenylcarbazole, etc.; and halogen or lower alkyl substitution products thereof. In the present invention, polymers containing the aforementioned π-electron systems are employed as the photoconductive polymer.

Specific examples of the photopolymer of the present invention include vinyl polymers such as polyvinyl naphthalene, polyvinyl anthracene, polyvinyl pyrene, polyvinyl perillene, polyacenaphthylene, polystyryl anthracene, polyvinyl carbazole, polyvinyl indole, polyvinyl acridine, etc.; vinyl ether polymers such as polyanthrylmethyl vinyl ether, polypyrenylmethyl vinyl ether, polycarbazolylethyl vinyl ether, polyindolylethyl vinyl ether, etc.; epoxy resins such as polyglycidyl carbazole, polyglycidyl indole, poly-p-glycidyl anthrylbenzene, etc.; homopolymers containing as substituent π-electron systems as described above such as polyacrylic acid esters containing as substituents the above-described $\pi$-electron systems, polymethacrylic acid esters containing as substituents the above-described $\pi$-electron systems, etc., and copolymers thereof; and condensation polymers prepared from the above-described $\pi$-electron system-containing compounds and formaldehyde.

Of the above photoconductive polymers, poly-N-vinylcarbazole and copolymers of N-vinylcarbazole are preferred. The copolymers which can be used as the N-vinylcarbazole copolymer in the present invention are those which contain as one of the polymer-forming constitutional repeating units, N-ethylenecarbazole having the structural formula:

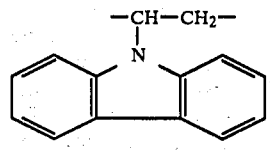

in an amount of about 50 mol % or more. Specific examples of polymer-forming constitutional repeating units which can be used to make up the balance of the N-vinylcarbazole copolymer include 1-phenylethylene, 1-cyanoethylene, 1-cyano-1-methylethylene, 1-chloroethylene, 1-(alkoxycarbonyl)ethylene and 1-alkoxycarbonyl-1-methylethylene. These are derived from styrene, acrylonitrile, methacrylonitrile, vinyl chloride, alkyl acrylate and alkyl methacrylate, respectively, wherein the alkyl moiety for the alkoxycarbonyl group may contain from 1 to 18 carbon atoms and specifically corresponds to a methyl group, an ethyl group, a hexyl group, a lauryl group, a stearyl group, a 4-methylcyclohexyl group and the like. [The term "constitutional repeating unit" used in the present invention follows the definition given in *Kobunshi*, Vol. 27, pp. 345–359 (1978) [a Japanese translation of *Pure and Applied Chemistry*, Vol. 48, pp. 373–385 (1976).]

1,4-Bis($\beta$-cyano-$\beta$-alkoxycarbonylvinyl)benzene represented by the general formula (I) can be used together with the photoconductive polymer in a mixing ratio of about 0.2 mol to 0.5 mol, preferably about 0.05 mol to 0.3 mol, per mol of $\pi$-electron system-containing constitutional repeating unit contained in the photoconductive polymer. In the case of poly-N-vinylcarbazole or N-vinylcarbazole copolymer, the term $\pi$-electron system-containing constitutional repeating unit refers to the unit of N-ethylenecarbazole.

Known sensitizers other than described above, a binder, a plasticizer, dyes, pigments and so on may be optionally incorporated into the photoconductive composition of the present invention in addition to the above-described components in such amounts as not to impair the characteristics of the photoconductive composition.

The photoconductive composition of the present invention can be prepared by dissolving the above-described essential components and optional components in an appropriate solvent in the mixing ratios desired to prepare a homogeneous solution (a solution of the photoconductive composition) and removing the solvent from the solution (e.g., by allowing the solvent to evaporate). Depending upon the purpose, the photoconductive composition may be used in the form of a solution without removing the solvent. The thus-obtained solution of the photoconductive composition is generally used to form the electrophotographic light-sensitive material when coated on a support having a conductive surface and dried to form a photoconductive layer. It is feasible to laminate an adhesion layer on the photoconductive layer depending upon the end-use of the electrophotographic light-sensitive material. Solvents useful for dissolving the photoconductive composition are those solvents which can dissolve both the aforementioned photoconductive polymers and the cyanovinyl compounds represented by the formula (I) with specific examples including tetrahydrofuran, dioxane, 1,2-dichloroethane, monochlorobenzene, cyclohexane and the like.

As examples of the support having a conductive surface, mention may be made of a drum or sheet of metals such as aluminium, copper, iron, zinc, etc.; and sheets of paper, plastic films or plates, glass plates, and so on the surfaces of which have been rendered conductive by vapor deposition of a metal, by lamination of a metal foil, or by coating with dispersions containing carbon black or metal powders in a binder.

Moreover, the photoconductive composition of the present invention can also be employed in the form of a dispersion prepared by granulating the photoconductive composition and then dispersing the resulting photoconductive particles in an insulating solvent. In this case, images are produced using a liquid electrophoretic image-forming photographic process as described in U.S. Pat. No. 3,384,565 (corresponding to Japanese Patent Publication No. 21781/68), U.S. Pat. No. 3,384,488 (corresponding to Japanese Patent Publication No. 37125/72), (U.S. Pat. No. 3,510,419 (corresponding to Japanese Patent Publication No. 36079/71), etc.

The photoconductive composition of the present invention possesses optical sensitivity in the wavelength region ranging from the ultraviolet to visible spectrum (to wavelengths of about 530 nm corresponding to yellow light), since 1,4-bis($\beta$-cyano-$\beta$-alkoxycarbonylvinyl)benzene and the $\pi$-electron system-containing constitutional repeating units contained in the photoconductive polymer form a charge transfer complex therein. In addition, the complex formation constant of the abovedescribed charge transfer complex is smaller than that of the charge transfer complex formed by trinitrofluorenone and polyvinyl carbazole. Therefore, the photoconductive composition of the present invention has the advantage that it is colored to a smaller extent and is used to greater advantage in preparing a colorless or lightly colored electrophotographic light-sensitive material (having as a support a sheet of paper or a film).

The present invention will now be illustrated in greater detail by reference to the following examples.

EXAMPLE 1

In 30 g of dichloroethane were dissolved 1 g of polyvinyl carbazole and 0.2 g of 1,4-bis($\beta$-cyano-$\beta$-ethoxycarbonylvinyl)benzene. The resulting solution was coated on a conductive film prepared by providing a layer of $In_2O_3$ having a thickness of 60 nm on a polyethylene terephthalate film 100 $\mu$m thick so as to form a film having a dry thickness of 1 $\mu$m. The thus-formed coat was dried at 80° C. for 30 minutes and then it was allowed to stand for one night in the dark. The thus-processed film could be charged so as to have either polarity by means of an about 100 V corona charging device. In the case of positive charging, the charge retained on the film after the passage of 1 minute was 95% of the charge created thereon by corona charging and, on the other hand, in the case of negative charging, the charge retained on the film after the passage of 1 minute was 98%. The positively charged film discharged 50% of its charge through 0.03 second's exposure to a tungsten lamp having an illuminance of 6,000 lux on the surface of the photoconductive layer. The negatively charged film also discharged 50% of its charge under the same condition described above.

EXAMPLE 2

In a mixed solvent composed of 100 g of methylene chloride and 50 g of an insulating solvent Isopar-H (a petroleum solvent of the isoparaffin series produced by Exxon Research & Engineering Co.) were dissolved 0.2 g of polyvinyl carbazole and 0.06 g of 1,4-bis(β-cyano-β-ethoxycarbonylvinyl)benzene. Thereafter, methylene chloride was removed from the solution by evaporating at 50° to 70° C. Thus, particles in which both polyvinyl carbazole and 1,4-bis(β-cyano-β-ethoxycarbonylvinyl)-benzene were compatibly present were obtained in such a state that they were dispersed in the Isopar-H. Using this dispersion, an image was formed according to the liquid electrophoretic image-forming process described in Japanese Patent Publication No. 21781/68 (corresponding to U.S. Pat. No. 3,384,565) by applying a 1,500 V negative voltage to the dispersion and subsequently exposing the dispersion to a tungsten lamp so that the illuminance on the surface of the dispersion of the photoconductive particles was 2 lux.

While the invention has been described in detail and with reference to specific embodiments thereof, it will be apparent to one skilled in the art that various changes and modifications can be made therein without departing from the spirit and scope thereof.

What is claimed is:

1. A photoconductive composition comprising photoconductive polymer and 1,4-bis(β-cyano-β-alkoxycarbonylvinyl)benzene represented by the following general formula (I) whose content ranges from 0.02 mol to 0.5 mol per mol of the π-electron system-containing constitutional repeating unit contained in said photoconductive polymer:

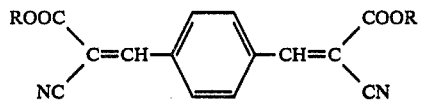

(I)

wherein R represents a methyl group, an ethyl group, a propyl group, or an isopropyl group.

2. An electrophotographic light-sensitive material comprising a support having a conductive surface on which a layer of the photoconductive composition defined in claim 1 is provided.

3. The photoconductive composition of claim 1, wherein the photoconductive polymer is a polymer of N-vinylcarbazole.

4. The photoconductive composition of claim 3, wherein said N-vinylcarbazole polymer is a copolymer containing about 50 mol % or more N-ethylenecarbazole constitutional repeating units.

5. The photoconductive composition of claim 1, wherein said 1,4-bis(β-cyano-β-alkoxycarbonylvinyl)-benzene is present in an amount of about 0.05 mol to 0.3 mol per mol of π-electron system.

6. The electrophotographic light-sensitive material of claim 2, wherein said photoconductive polymer is an N-vinylcarbazole polymer.

7. The electrophotographic light-sensitive material of claim 6, wherein said N-vinylcarbazole polymer is a copolymer containing about 50 mol % or more N-ethylenecarbazole constitutional repeating units.

8. The electrophotographic light-sensitive material of claim 2, wherein said 1,4-bis(β-cyano-β-alkoxycarbonylvinyl)benzene is present in an amount of about 0.05 mol to 0.3 mol per mol of π-electron system.

9. The electrophotographic light-sensitive material of claim 1, wherein R represents a methyl group.

10. The electrophotographic light-sensitive material of claim 1, wherein R represents an ethyl group.

11. The electrophotographic light-sensitive material of claim 1, wherein R represents a propyl group.

12. The electrophotographic light-sensitive material of claim 1, wherein R represents an isopropyl group.

* * * * *